US007976005B2

(12) United States Patent
Ichikawa et al.

(10) Patent No.: US 7,976,005 B2
(45) Date of Patent: Jul. 12, 2011

(54) PAPER SHEETS STORAGE AND PAPER SHEETS HANDLING APPARATUS

(75) Inventors: Hiroshi Ichikawa, Okazaki (JP); Shinji Shibata, Nagoya (JP); Minoru Kadowaki, Toyota (JP); Riichi Kato, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 486 days.

(21) Appl. No.: 11/955,523

(22) Filed: Dec. 13, 2007

(65) Prior Publication Data

US 2008/0150216 A1 Jun. 26, 2008

(30) Foreign Application Priority Data

Dec. 15, 2006 (JP) ..... 2006-338254

(51) Int. Cl.
*B65H 5/22* (2006.01)

(52) U.S. Cl. ..... 271/3.01; 271/3.14; 271/4.01

(58) Field of Classification Search ..... 271/3.01, 271/3.14, 4.01, 10.01; 209/534; 235/379; 194/206

See application file for complete search history.

(56) References Cited

U.S. PATENT DOCUMENTS

| | | | | |
|---|---|---|---|---|
| 5,313,050 | A * | 5/1994 | Hiroki et al. | 235/379 |
| 6,481,620 | B1 | 11/2002 | Katou et al. | |
| 6,749,053 | B2 * | 6/2004 | Ikuta | 194/206 |
| 6,789,682 | B2 * | 9/2004 | Minamishin et al. | 209/534 |
| 6,889,849 | B2 * | 5/2005 | Heidel et al. | 209/534 |
| 6,942,207 | B2 * | 9/2005 | Katou et al. | 271/3.01 |
| 7,644,914 | B2 * | 1/2010 | Katou et al. | 271/3.14 |
| 2002/0014736 | A1 | 2/2002 | Katou et al. | |
| 2002/0033359 | A1 | 3/2002 | Graef et al. | |
| 2002/0074709 | A1 * | 6/2002 | Kanagawa | 271/3.14 |
| 2002/0088850 | A1 * | 7/2002 | Katou et al. | 235/379 |
| 2002/0092905 | A1 * | 7/2002 | Katou et al. | 235/379 |

(Continued)

FOREIGN PATENT DOCUMENTS

EP 1 326 215 11/2002

(Continued)

OTHER PUBLICATIONS

European Search Report; Application No. EP 07 02 4293; Date: Feb. 3, 2011.

*Primary Examiner* — Kaitlin S Joerger
(74) *Attorney, Agent, or Firm* — Antonelli, Terry, Stout & Kraus, LLP.

(57) ABSTRACT

The provides a two money kinds recycle box provided with a plurality of paper money accumulating portions and storing and feeding the paper money at one position, thereby simplifying a carrier path structure of a whole of a paper money inputting and outputting machine provided with the two money kinds recycle box, and corresponding to a lot of money kinds with a compact structure. The two money kinds recycle box is provided with an output and input port outputting and inputting the paper money with respect to an external portion, a plurality of paper money accumulating portions storing the paper money, a pickup roller provided at one position of each of the paper money accumulating portions and carrying out an accumulating motion of the paper sheets onto the paper money accumulating portions and a feeding motion of the paper sheets from the accumulating portions, and a two-way carrier path carrying the paper sheets in a two-way direction between the one output and input port and a plurality of pickup rollers.

9 Claims, 10 Drawing Sheets

U.S. PATENT DOCUMENTS

| | | | | |
|---|---|---|---|---|
| 2002/0180136 | A1* | 12/2002 | Amari et al. | 271/3.14 |
| 2007/0023988 | A1* | 2/2007 | Abe et al. | 271/3.01 |
| 2009/0085274 | A1* | 4/2009 | Katou et al. | 271/3.14 |

FOREIGN PATENT DOCUMENTS

| | | |
|---|---|---|
| GB | 2 301 092 | 11/1996 |
| GB | 2 365 193 A | 2/2002 |
| JP | 2001-118111 | 4/2001 |
| JP | 2001-236546 | 8/2001 |
| JP | 2004-102461 | 4/2004 |
| JP | 2004-240904 | 8/2004 |
| JP | 2005-208965 | 8/2005 |
| JP | 2006-021860 | 1/2006 |
| WO | WO 99/28224 | 6/1999 |

* cited by examiner

PAPER SHEETS STORAGE AND PAPER SHEETS HANDLING APPARATUS

INCORPORATION BY REFERENCE

The present application claims priority from Japanese application JP2006-338254 filed on Dec. 15, 2006, the content of which is hereby incorporated by reference into this application.

BACKGROUND OF THE INVENTION

1. Field of the Invention

The present invention relates to a paper sheets handling apparatus such as to handle paper sheets, for example, an automated teller machine (ATM) installed in a financial institution and the like, and a paper sheets storage provided in the paper sheets handling apparatus.

2. Description of Related Art

Conventionally, in a paper money input and output machine mounted to an automated teller machine (so-called ATM), for example, used in a financial institution or the like, there are provided an input and output port allowing a user to throw the paper money in so as to carry out a process of feeding out the input paper money and carrying out a process of discharging the paper money to the user, a paper money discriminating portion discriminating the paper money, and a paper money carrier path carrying the paper money. In this paper money input and output machine, there are further provided with a temporary storage temporarily storing the input paper money, a reject box storing a reject paper money which is discriminated not to reach a predetermined reference by the paper money discriminating portion, and a recycle box storing and feeding out the paper money for both paper money input and output. The paper money input and output machine can correspond more money kinds in accordance with an increase of the number of the recycle box.

In this case, as a paper money storage of a paper money input and output machine which can correspond a lot of money kinds, there has been proposed a teller paper money unit having two paper money separating stack portions in one recycle box (refer to patent document 1 (JP-A-2001-236546)).

In this teller paper money unit, since a carrier path within the storage is structured such as to carry in one direction, the storage and a whole carrier path are connected at two positions including an inlet and an outlet. Accordingly, there is a problem that a structure of the carrier path around the storage becomes complicated.

BRIEF SUMMARY OF THE INVENTION

The present invention is made by taking the problem mentioned above into consideration, and an object of the present invention is to provide a paper sheets storage provided with a plurality of storage portions storing paper sheets and storing and feeding out the paper sheets at one position, thereby simplifying a carrier path structure of a whole of an apparatus provided with the paper sheets storage, and corresponding to a lot of money kinds with a compact structure.

In accordance with the present invention, there is provided a paper sheets storage comprising:

one paper sheets output and input portion outputting and inputting paper sheets with respect to an external portion;

a plurality of storage portions storing the paper sheets;

an accumulating and feeding motion portion provided at one position in each of the storage portions and carrying out an accumulating motion of the paper sheet to the storage portion and a feeding motion of the paper sheets from the storage portion; and an internal carrier path carrying the paper sheets in a two-way direction between the one paper sheets output and input portion and the plurality of accumulating and feeding motion portions.

In the present invention, it is preferable that the paper sheets output and input portion is provided with a delivering motion portion corresponding to a delivery end of the paper sheets, independently driven from an external carrier path provided in an external portion and carrying out a motion of delivering the paper sheets to the external carrier path.

Further, in the paper sheets storage of the present invention, it is preferable that the paper sheets output and input portion is provided with a delivering motion portion independently driven from the accumulating and delivering motion portion, corresponding to a delivery end of the paper sheets and carrying out a motion of delivering the paper sheets to an external carrier path provided in the external portion.

Further, it is preferable that the paper sheets storage of the present invention is further provided with a stage supporting the stored paper sheets in a state in which a plurality of paper sheets are superimposed, in each of the storage portions, and a stage moving means for moving the stage in the superimposing direction independently from the stage of the other storage portion, and a plurality of the accumulating and feeding motion portions are interlocked by one driving means.

Further, in the paper sheets storage of the present invention, it is preferable that a detecting means for detecting a feed fault of the paper sheets is provided near each of the accumulating and feeding motion portions, and in the case that the feed fault is detected by the detecting means, the accumulating and feeding motion portion is driven in a reverse direction by the driving means while keeping the carrying drive of the internal carrier path.

Further, in accordance with the present invention, there is provided a paper sheets handling apparatus comprising:

an input and output port allowing an input and output of paper sheets by a user;

a discriminating portion discriminating the paper sheets;

a carrier path carrying the paper sheets; and a plurality of storage installing portions to which the paper sheets storage as recited in any one of the aspects mentioned above is installable, wherein the storage installing portions are structured such as to be installable to a single paper sheets storage provided with one storage portion storing the paper sheets, and one accumulating and feeding motion portion carrying out an accumulating motion of the paper sheets to the storage portion and a feeding motion of the paper sheets from the storage portion.

In accordance with the present invention, it is possible to provide the paper sheets storage provided with a plurality of storage portions storing the paper sheets and storing and feeding out the paper sheets at one position, thereby simplifying the carrier path structure of a whole of the apparatus provided with the paper sheets storage, and corresponding to a lot of money kinds with the compact structure.

Other objects, features and advantages of the invention will become apparent from the following description of the embodiments of the invention taken in conjunction with the accompanying drawings.

DETAILED DESCRIPTION OF THE INVENTION

A description will be given below of an embodiment in accordance with the present invention with reference to the accompanying drawings.

Embodiment 1

Figure 1:
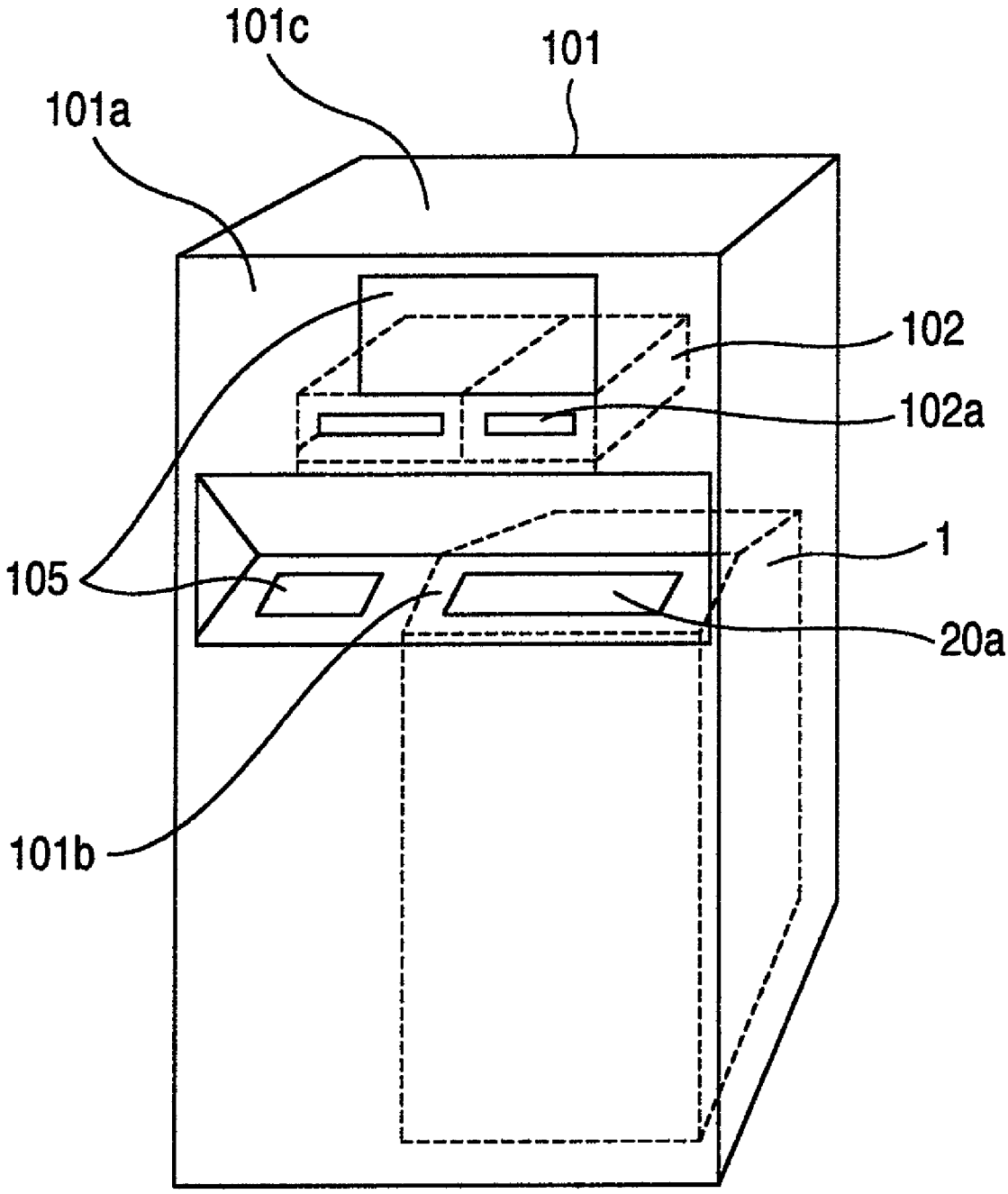
FIG. 1 is a perspective view showing an outer appearance of an automatic teller machine.

FIG. 1 is a perspective view showing an outer appearance of an automated teller machine.

An inner portion of an upper right portion of an automated teller machine 101 is provided with a card and specified list handling mechanism 102 communicating with a card slot 102*a* arranged in an upper front plate 101*a* so as to handle a card of a user, and printing a deal specified list so as to discharge. Further, a front surface of the automated teller machine 101 is provided with a customer operating portion 105 on which contents of the deal is displayed and input. A whole of the automated teller machine 101 is surrounded by an apparatus casing 101*c*. An inner portion of a lower right portion of the automated teller machine 101 is provided with a paper money input and output machine 1 serving as a paper sheets handling apparatus handling the paper money corresponding to the paper sheets, and a paper money slot 20*a* is provided in a front surface plate 101*b* having an inclined upper portion. The automated teller machine 101 is structured such as to carry out a deposit, a payment, a funds transfer and the like by the user via the card, the paper money and the specified list.

Figure 2:
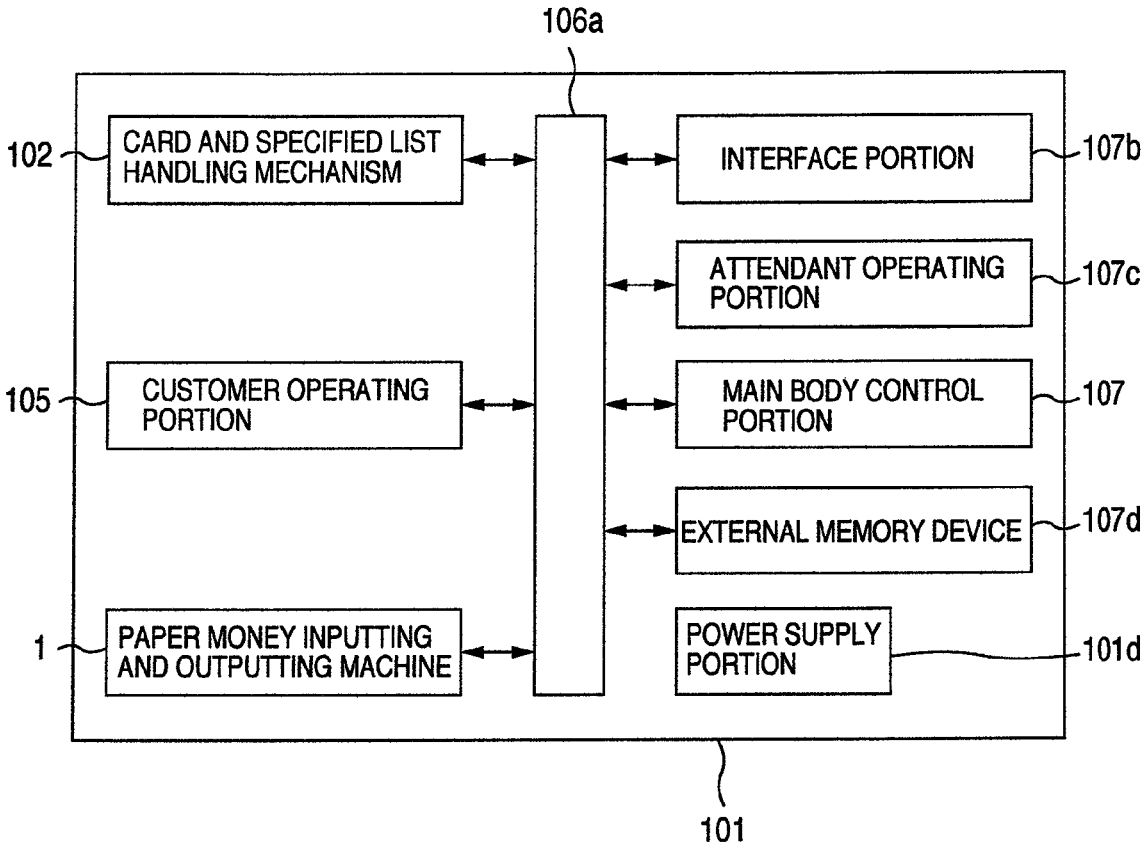
FIG. 2 is a control block diagram showing a control relation of the automatic teller machine.

FIG. 2 is a control block diagram showing a control relation of the automated teller machine 101 in FIG. 1.

The automated teller machine 101 is provided with the card and specified list handling mechanism 102, the paper money input and output machine 1 and the customer operating portion 105 so as to be connected to the main body control portion 107 via a bus 106*a*. The card and specified list handling mechanism 102, the paper money input and output machine 1 and the customer operating portion 105 carry out a necessary motion under the control of the main body control portion 107.

The main body control portion 107 is additionally connected to an interface portion 107*b*, an attendant operating portion 107*c* and an external memory device 107*d* via the bus 106*a*, and a necessary data interaction is carried out, however, since this does not have a direct relation to the feature of the present invention, a detailed description thereof will be omitted. In this case, reference symbol 101*d* shown in FIG. 2 denotes a power supply portion supplying an electric power to each of the mechanism portions and constituting portions mentioned above.

Figure 3:
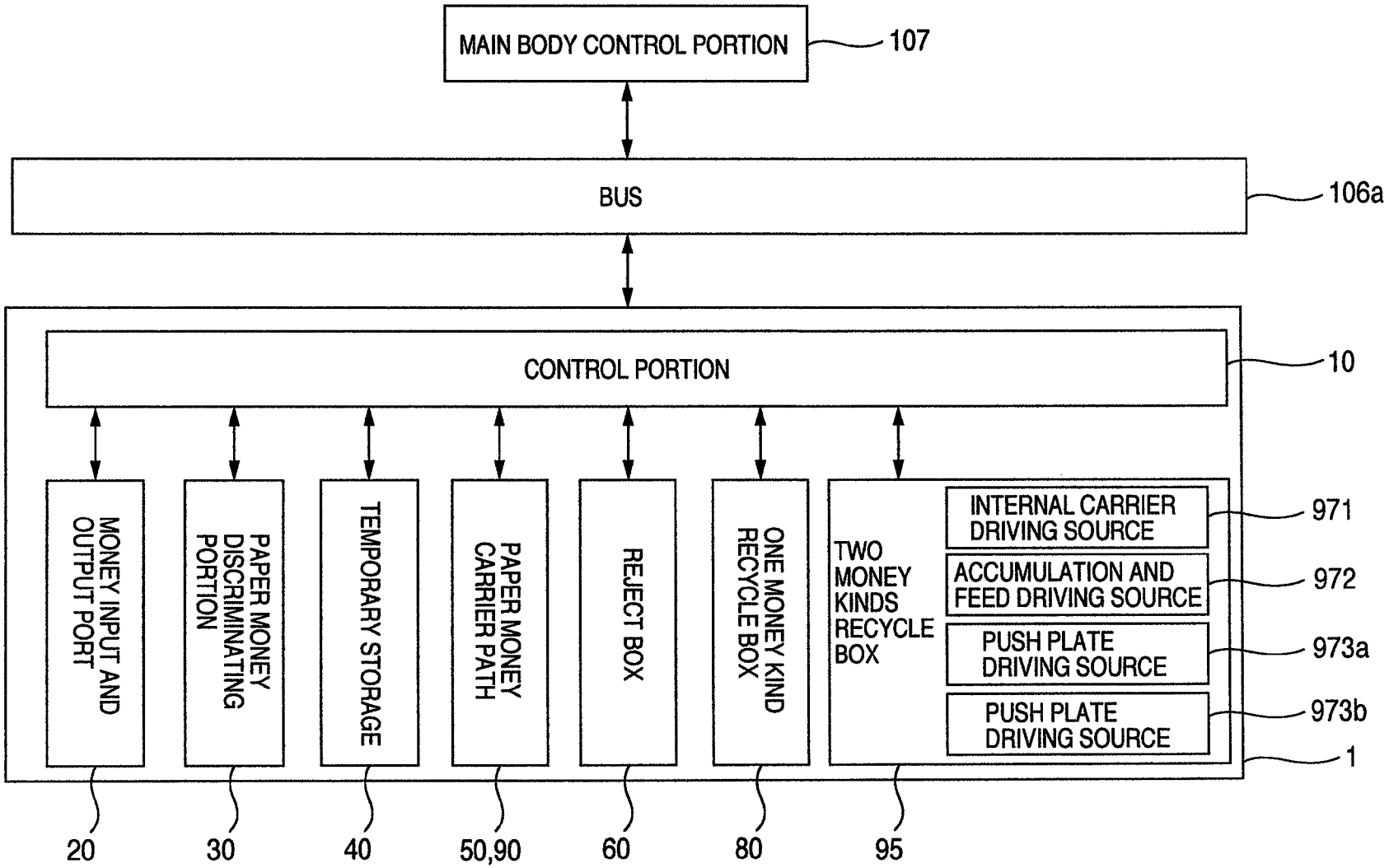
FIG. 3 is a control block diagram showing a control relation of a paper money input and output machine.

FIG. 3 is a control block diagram showing a control relation of the paper money input and output machine 1 arranged in the automated teller machine 101 in FIG. 1.

The control portion 10 of the paper money input and output machine 1 is connected to the main body control portion 107 of the automated teller machine 101 via the bus 106*a*, and carries out a control of the paper money input and output machine 1 in correspondence to a command from the main body control portion 107 and a state detection of the paper money input and output machine 1. Further, the control portion 10 transmits the state of the paper money input and output machine 1 to the main body control portion 107 as occasion demands.

The paper money input and output machine 1 also has a driving motor of each of units (a money input and output port 20, a paper money discriminating portion 30 serving as the discriminating portion, a temporary storage 40, paper money carrier paths 50 and 90 serving as the carrier path, a reject box 60, a one money kind recycle box 80 serving as the single paper sheets storage, and a two money kinds recycle box 95 serving as the paper sheets storage), an electromagnetic solenoid, plural lines of sensors and the like (not shown), and controls so as to drive an actuator (the driving motor, the electromagnetic solenoid and the like) while monitoring the state by the sensor in correspondence to a deal mentioned below. Further, the two money kinds recycle box 95 is provided with an internal portion carrier driving source 971, an accumulation and feed driving source 972 serving as the driving means, and push plate driving sources 973*a* and 973*b* serving as the stage moving means, as four independent driving sources. Each of these driving sources 971, 972, 973*a* and 973*b* is constituted by a driving means such as a motor or the like.

Figure 4:
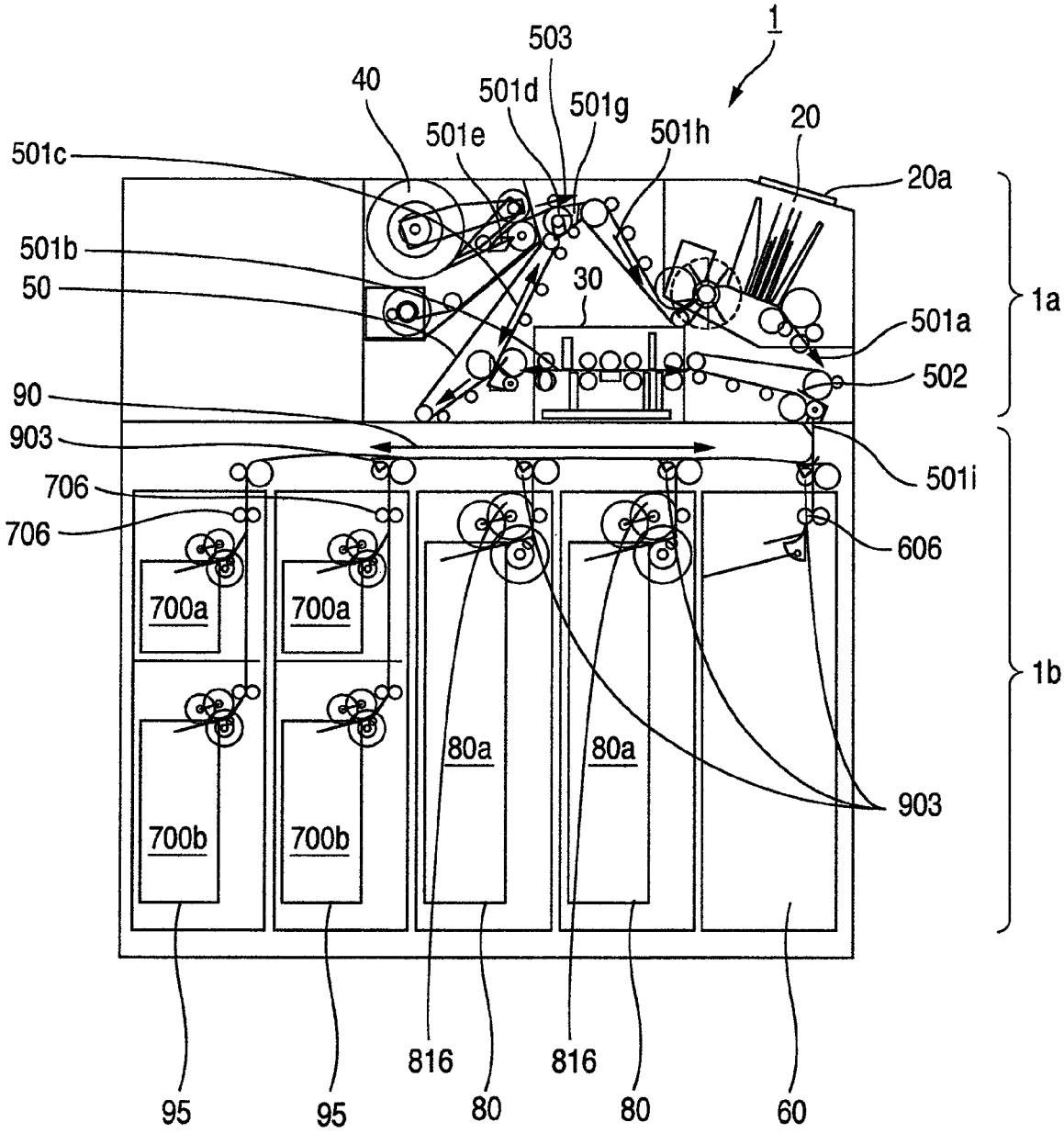
FIG. 4 is a side elevational view showing a structure of the paper money input and output machine.

FIG. 4 is a side elevational view showing a structure of the paper money input and output machine 1.

The paper money input and output machine 1 is constituted by the money input and output port 20 by which the user throws in and picks up the paper money at a time when the paper money slot 20*a* is in an open state, the paper money discriminating portion 30 carrying out the discrimination of the paper money, the temporary storage 40 temporarily accommodating the input paper money until the deal is established, the reject box 60 storing the paper money which is not provided to be output, the one money kind recycle box 80 having one paper money accumulating portion 80*a*, storing the paper money in which the money input time deal is established and providing the paper money to the money output, the two money kind recycle box 95 having two paper money accumulating portions 700*a* and 700*b* serving as a plurality of storing portions, storing the paper money in which the deal is established at a time of inputting the money and providing the paper money for outputting the money at a time of outputting the money, the paper money carrier path 50 (501*a* to 501*i*) carrying the paper money among the money input and output port 20, the temporary storage 40, the reject box 60, the one money kind recycle box 80, and the two money kind recycle box 95 while passing through the paper money discriminating portion 30, the paper money carrier path 90 serving as the external carrier path, and the control portion 10. In this case, the control portion 10 is omitted in FIG. 4 (refer to FIG. 3). Details of the two money kind recycle box 95 will be described later.

Further, the paper money input and output machine 1 is structured such as to be broadly divided into an upper paper money mechanism 1*a* and a lower paper money mechanism 1*b* serving as the storage installing portion. Further, the upper paper money mechanism 1*a* is constituted by the money input and output port 20, the paper money discriminating portion 30, the temporary storage 40, and the paper money carrier path 50 (501*a* to 501*i*). On the other hand, the lower paper money mechanism 1*b* is constituted by the reject box 60, the one money kind recycle box 80, the two money kinds recycle box 95, and the paper money carrier path 90 arranged in an upper surface of each of the recycle boxes 80 and 95. The respective recycle boxes 80 and 95 are aligned in a line, and the paper money carrier path 90 carries the paper money in this aligning direction (a horizontal direction in the illustrated example) in a two-way direction.

Further, the paper money carrier path 50 (501*a* to 501*i*) of the upper paper money mechanism 1*a* passes through the paper money discriminating portion 30 in the two-way direction, and connects the money input and output port 20, the temporary storage 40, the reject box 60, the one money kind recycle box 80 and the two money kinds recycle box 95 to each other via the paper money carrier paths shown by arrows 501*a* to 501*i* and an arrow 90 (in which the paper money carrier path and the arrow are described by the same reference numeral conveniently). A one-way arrow in the arrows indicates a one-way paper money carrier path along which the paper money is carried only in the direction of the arrow, and a two-way arrow indicates a two-way direction carrier path which is switched to any one of two directions per a dealing motion of the paper money so as to carry. Further, switching gates 502 and 503 and four switching gates 903 are provided at respective branch points in the paper money carrier paths 50 and 90, and switch the paper money carrier direction per the dealing motion. The money input and output dealing process by the user is carried out by the paper money input and output machine having the structure mentioned above.

In this case, in detail describing a difference among the reject box 60, the one money kind recycle box 80 and the two money kind recycle box 95, the reject box 60 can store many money kinds of paper moneys, and is used in the case of storing the money kind which is not used for recycle and the reject paper money generated at a time of inputting and outputting the money. The one money kind recycle box 80 is different from the reject box, and can input and output the paper money in spite that the money kind to be handled is one. The two money kind recycle body 95 is structured such that each of the paper money accumulating portions 700*a* and 700*b* can input and output the paper money in the same manner as the one money kind recycle box 80.

Figure 5:
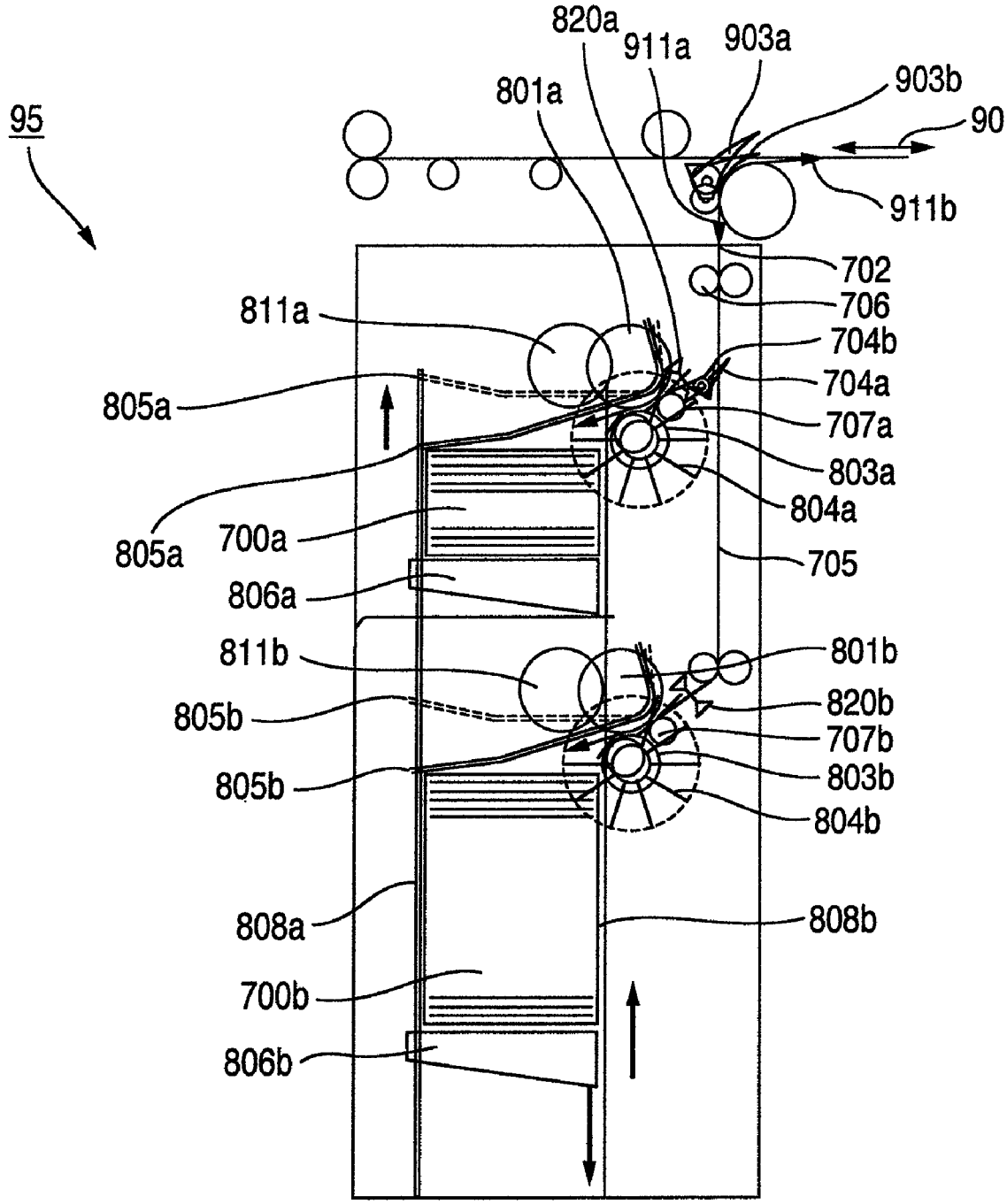
FIG. 5 is a schematic view of a two money kinds recycle box.

FIG. 5 shows a structure example of the two money kind recycle box 95. The two money kind recycle box 95 corresponds to a storage having totally two independent paper money accumulating portions 700*a* and 700*b*. The paper money accumulating portions 700*a* and 700*b* correspond to a storage portion which can store and separately feed the paper money, and are arranged in this order from the above in a direction (a vertical direction) perpendicular to the carrier direction (a horizontal direction) of the paper money carrier path 90. An output and input port 702 serving as the paper money output and input portion provided in the two money kinds recycle box 95 corresponds to an output and input port common to two paper money accumulating portions 700*a* and 700*b*, and carries out a delivery of the paper money with respect to the paper money carrier path 90 in the external portion of the two money kinds recycle box 95.

A delivery roller 706 serving as the delivering motion portion is provided in the output and input port 702 corresponding to a connection portion delivering the paper money from the two money kinds recycle box 95 to the paper money carrier path 90. On the basis of the delivery roller 706, it is possible to feed out the paper money from the two money kinds recycle box 95 to the paper money carrier path 90, or it is possible to receive the paper money in the two money kinds recycle box 95 from the paper money carrier path 90.

The output and input port 702 and the paper money accumulating portions 700*a* and 700*b* are coupled by the delivery roller 706, and the two-way carrier path 705 serving as the internal carrier path carrying the paper money in the direction (the vertical direction) perpendicular to the carrying direction (the horizontal direction) of the paper money carrier path 90, and the paper money is carried in the two-way direction between the output and input port 702 and the paper money accumulating portion 700*a*, and between the output and input port 702 and the paper money accumulating portion 700*b*.

At a time of inputting the money, the paper money carried in from the output and input port 702 is carried to the delivery roller 706, is carried to the paper money accumulating portion 700*a* at a time when the switching gate 704 is switched to the direction 704*a*, and is carried to the paper money accumulating portion 700*b* via the two-way carrier path 705 at a time when the switching gate 704 is switched to the direction 704*b*.

In each of the paper money accumulating portions 700 (700*a* and 700*b*), a stack and separating mechanism is constituted by stack and feed rollers 801 (801*a* and 801*b*), pickup rollers 811 (811*a* and 811*b*), gate rollers 803 (803*a* and 803*b*) rotating in a stack direction and not rotating in a feeding direction, brush rollers 804 (804*a* and 804*b*) existing on the same axis of the gate roller 803 and having elastic members arranged radially, and separating and stack guides 805 (805*a* and 805*b*) being movable at the separating time and the stacking time. The accumulating and feeding motion portion is constituted by the stack and feed rollers 801, the gate roller 803 and the pickup rollers 811. The paper money is stored in a storage space (the paper money accumulating portions 700*a* and 700*b*) surrounded by push plates 806 (806*a* and 806*b*) serving as the stage moving up and down by an appropriate driving means such as a motor or the like, and side plates 808*a* and 808*b* provided back and forth.

At the stacking motion time of the paper money, the separating and stack guide 805 is moved to a position shown by a solid line, and the push plate 806 is moved by a driving force of push plate driving sources 973 (973*a* and 973*b*) within the paper money accumulating portion 700 corresponding to the storage space. The push plate 806 is controlled so as to be moved in a direction of moving down the stored paper money in accordance with an increase of the stored paper money, in such a manner as to prevent the approaching paper money carried in the direction of an arrow 911*a* and the stored paper money from being interfered with each other. Further, it is preferable that an intake speed of the paper money by the stack and feed roller 801 is equal to or higher than the carrying speed of the paper money by the two-way carrier path 705, and is set to the same speed in this embodiment.

At the separating motion time of the paper money, the separating and stack guide 805 is moved to a position shown by a broken line, and the push plate 806 can be moved to the upper side within the paper money accumulating portion 700. Further, the stored paper money is moved by a spring (not shown) in such a manner that the fed paper money is pressed to the pickup roller 811 by a predetermined pressing force. At this time, the push plates 806*a* and 806*b* are respectively driven by independent push plate driving sources 973*a* and 973*b*.

This is because the paper money within the paper money accumulating portion 700*a* moves up the push plate 806*a* in such a manner that a predetermined pressing force is applied to the pickup roller 811*a*, and the paper money accumulating portion 700*b* moves down the push plate 806*b* to such a position that the pickup roller 811*b* is not in contact with the paper money within the paper money accumulating portion 700*b*, for example, at a time of separating the paper money from the paper money accumulating portion 700*a*.

Further, it is preferable that a feeding speed of the paper money by the pickup roller 811 is equal to or lower than the carrying speed of the paper money by the two-way carrier path 705, and is set to approximately the same speed in this embodiment.

At a time of reversely separating the paper money from the paper money accumulating portion 700*b*, the paper money within the paper money accumulating portion 700*b* moves up the push plate 806*b* in such a manner that a predetermined pressing force is applied to the pickup roller 811*b*, and the paper money accumulating portion 700*a* moves down the push plate 806*a* to such a position that the pickup roller 811*a* is not in contact with the paper money within the paper money accumulating portion 700*a* in such a manner as to prevent the paper money from being fed.

Accordingly, it is possible to achieve a motion that the paper money is not fed from the other during the paper money is fed from one of a plurality of paper money accumulating portions 700*a* and 700*b*. Accordingly, it is possible to prevent the paper money from being fed from both of the paper money accumulating portions 700*a* and 700*b* so as to generate a jam within the two-way carrier path 705.

Since it is necessary to control an ascending amount and a descending amount of the push plates 806*a* and 806*b* on the basis of the number of the paper money accumulated in each of the paper money accumulating portions 700*a* and 700*b* even in the case of the stack motion time, the push plates 806*a* and 806*b* are respectively controlled by the independent push plate driving sources 973*a* and 973*b*.

An independent special delivery roller 706 from the stack and feed roller 801 is provided in the output and input port 702 forming the delivery portion of the paper money between the two money kinds recycle box 95 and the paper money carrier path 90. The delivery roller 706 and the two-way carrier path 705 are driven in an interlocking manner by one internal carrier driving source 971. Further, the stack and feed rollers 801*a* and 801*b* and the pickup rollers 811*a* and 811*b* are driven in an interlocking manner by one accumulation and feed driving source 972. Accordingly, the structure is made such that the delivery roller 706 and the two-way carrier path 705, and the stack and feed rollers 801*a* and 801*b* and the pickup rollers 811*a* and 811*b* are respectively driven by the different independent internal carrier driving source 971 and accumulation and feed driving source 972. Particularly, the structure is made such as to separately drive the stack and feed roller 801 and the delivery roller 706 respectively independently.

The paper money pressed to the pickup roller 811 is discharged by the rotating stack and feed roller 801, passes through the first pinch rollers 707 (707*a* and 707*b*) while being prevented the double feed by the gate roller 803 which is not rotated in the feeding direction, and is discharged directly to the delivery roller 706 or is discharged to the delivery roller 706 via the two-way carrier path 705. The switching gate 903 of the paper money carrier path 90 is switched in such a manner that the paper money is carried in the direction of the arrow 911*b*, and the paper money is carried to the paper money carrier path 90 from the output and input port 702 one by one.

After separating a predetermined number of paper money and finishing the discharge to the delivery roller 706 or the two-way carrier path 705, the driving of the stack and feed roller 801 is stopped. Subsequently, after discharging all the paper moneys within the two-way carrier path 705 and the delivery roller 706, the driving of the two-way carrier path 705 and the delivery roller 706 is stopped.

On the basis of the motion mentioned above, it is possible to deliver the paper money existing within the two-way carrier path 705 and in the delivery roller 706 portion normally to the paper money carrier path 90 at a time of finishing the separating motion, thereby finishing the motion.

Detection sensors 820 (820*a* and 820*b*) serving as the detecting means for detecting the feed fault of the paper money are respectively provided near the first pinch rollers 707. The structure is made such as to reverse rotate the stack and feed roller 801 at one rotation so as to return the paper money into the paper money accumulating portion while keeping the two-way carrier path 705 being driven in the feeding direction if the feed fault of the paper money is detected by the detection sensors 820. Accordingly, it is possible to dissolve the paper money clog at a time of the feed fault of the paper money so as to again feed.

Further, the first pinch roller 707 and the two-way carrier path 705 are structured such that a pinching force of the first pinch roller 707 is stronger than a pinching force of the two-way carrier path 705 in a relation of the pinching force. Accordingly, even in the case that the paper money stops in a state in which the paper money is pinched by the stack and feed roller 801 and the first pinch roller 707 due to the feed fault, it is possible to prevent the paper money having the feed fault from being pinched by the two-way carrier path 705 so as to be carried.

Further, the structure is made such that the internal carrier driving source 971 keeps the motion of driving the two-way carrier path 705 in the carrying direction at the fixed speed during a while the reverse rotation control of the stack and feed roller 801 is carried out due to the feed fault. Even in this structure, since the pinching force of the first pinch roller 707 is stronger than the pinching force of the two-way carrier path 705, the stack and feed roller 801 can move the paper money in the reverse rotating direction against the force that the two-way carrier path 705 is going to carry the paper money, and it is possible to dissolve the paper money clog.

In the paper money input and output machine 1 structured as mentioned above, each of the storages including the two money kinds recycle box 95, the reject box 60 and the one money kind recycle box 80 is structured on the basis of a common structure in an outer shape dimension, a position of the output and input port of the paper money (702 in the case of the two money kinds recycle box 95), a nesting shape of a guide in the output and input port and a carrier driving portion (not shown). Further, the pinching point positions of the rollers (706, 606 and 816) in the paper money output and input ports in the side of the respective storages are structured identical in the storages. Accordingly, it is possible to make the respective storages have compatibility, thereby obtaining a structure which can be made use by freely changing the combination.

Particularly, since the two money kinds recycle box 95 has the two-way carrier path 705 in the inner portion thereof in comparison with the one money kind recycle box 80, it is necessary to make the structure of the paper money accumulating and separating portion smaller than the one money kind recycle box 80. Accordingly, the mechanism such as the roller or the like for accumulating and separating the paper money is structured small in the two money kind recycle box 95, and the rollers (706, 606 and 816) are arranged in such a manner that the paper money delivery portion with respect to the paper money carrier path 90 becomes identical with the one money kind recycle box 80. Therefore, the two money kinds recycle box 95 can make the paper money delivery portion between each of the storages and the paper money carrier path 90 common so as to achieve the competitive structure while keeping the outer shape dimension common.

Next, a description will be given of a motion of the paper money input and output machine 1 having the structure mentioned above.

A description will be given first of a motion at a time of the money input dealing process.

At a time of the money input dealing process, the paper moneys thrown in the money input and output port 20 are separated one by one, and the money kind and truth of the paper money are determined by the paper money discriminating portion 30. The paper money discriminated by the paper money discriminating portion 30 switches the switching gate 503 and is temporarily stored in the temporary storage 40. In the case of the paper money which can not be discriminated by the determination of the paper money discriminating portion 30, the paper money in which an inclination is generated, and the paper money having an abnormal space between the paper moneys (for example, the overlapped paper money), the paper money is determined as a paper money to be rejected (hereinafter, refer to a reject paper money). The reject paper money is not taken in the temporary storage 40, but switches the switching gate 503, is returned to the money input and output port 20 so as to be stored, and is returned to the user.

If an amount of money of the input money coincides with a counted amount of money, and the money input deal is decided by the user, the paper money temporarily stored in the temporary storage 40 is discharged in the reverse direction in a reverse order to the order at a time of storing, and passes through the paper money discriminating portion 30. Further, the switching gate 502 is switched, and the switching gate 903 of any one of the reject box 60, the one money kind recycle box 80 and the two money kind recycle box 95 is switched, whereby the paper money passing through the paper money discriminating portion 30 is stored in the designated storage. Accordingly, the money input dealing process is finished.

Figure 6:
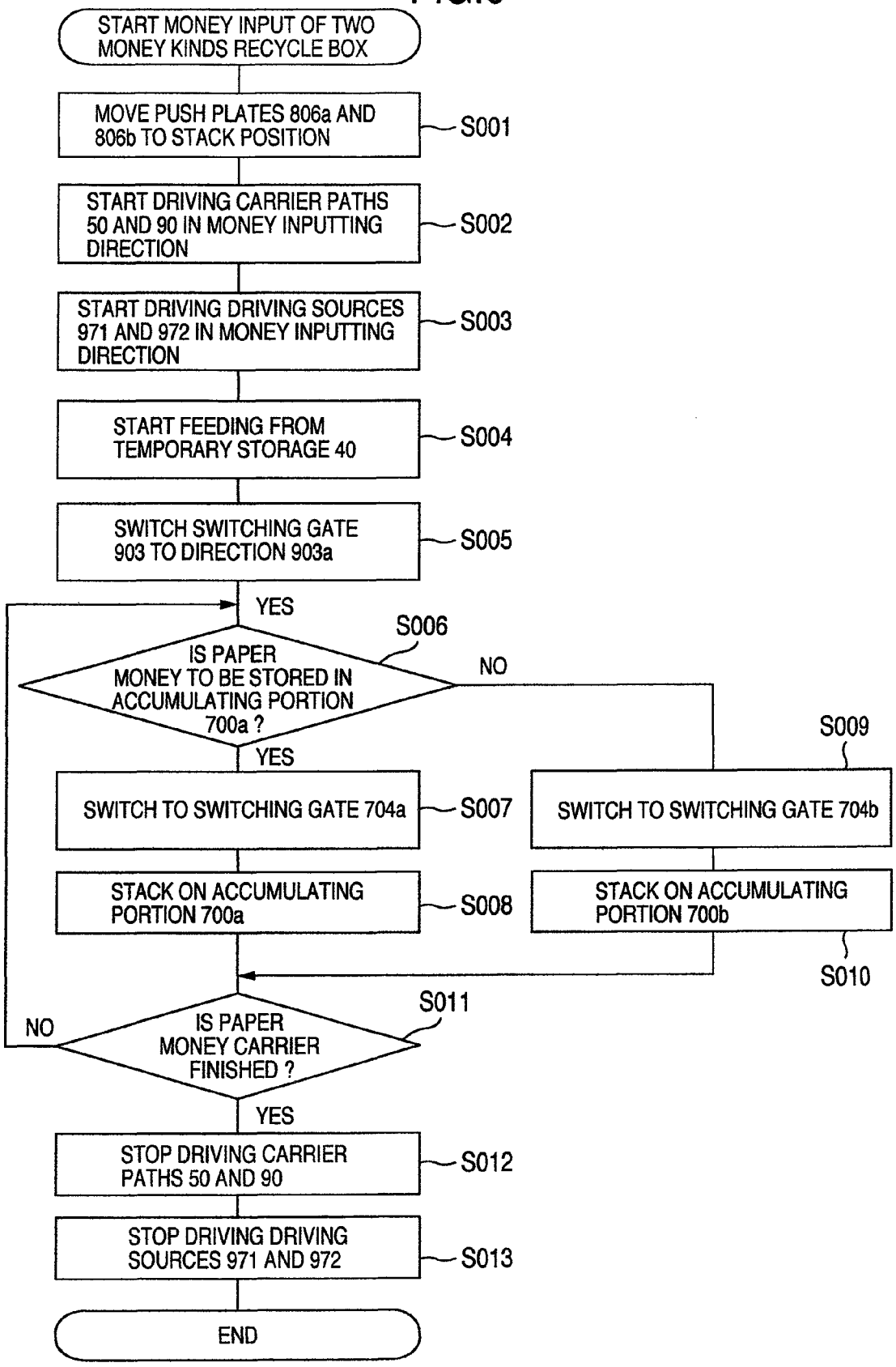
FIG. 6 is a flow chart of an accumulating motion of the paper money to the two money kind recycle box.

FIG. 6 is a flow chart mainly showing the storing motion in the two money kinds recycle box 95 at a time of the money input dealing process mentioned above.

First, the control portion 10 drives each of the push plates 806*a* and 806*b* in such a manner that a height of the paper money on a top surface of the paper money on the push plate 806 or the push plate 806 comes to a height (a stack position) suitable for stacking (a step S001). At this time, since the push plates 806*a* and 806*b* are driven by the independent driving sources, the push plates 806*a* and 806*b* moves the paper money to the respective heights even if the numbers of the paper moneys are different.

The control portion 10 starts driving the paper money carrier paths 50 and 90 in the money inputting direction (a step S002).

The control portion 10 drives the delivery roller 706 and the two-way carrier path 705 in the money inputting direction by driving the internal carrier driving source 971 in the money inputting direction. Further, the control portion 10 drives the stack and feed rollers 801*a* and 811*b* and the pickup rollers 811*a* and 811*b* in the money inputting direction by driving the accumulation and feed driving source 972 in the money inputting direction (a step S003).

The control portion 10 starts feeding the paper money from the temporary storage 40 (a step S004).

The control portion 10 switches the switching gate 903 (the gate short of the two money kind recycle box 95) to a direction 903*a* so as to make the paper money come into the two money kinds recycle box (a step S005).

The control portion 10 determines whether or not the paper money is the paper money accumulated in the paper money accumulating portion 700*a* or the paper money accumulated in the paper money accumulating portion 700*b* (a step S006).

In the case of the paper money accumulated in the paper money accumulating portion 700*a* (YES in the step S006), the control portion 10 switches the switching gate 704 to a direction 704*a* in such a manner that the paper money comes in the paper money accumulating portion 700*a* (a step S007). Accordingly, the carried paper moneys are stacked in the paper money accumulating portion 700*a* (a step S008). During this time, the control portion 10 executes the money inputting time push plate control of adjusting the height of the push plate 806*a* in correspondence to the height of the stacked paper money.

In the case that the step S006 mentioned above determines that the paper money is accumulated in the paper money accumulating portion 700*b* (NO in the step S006), the control portion 10 switches the switching gate 704 to a direction 704*b* in such a manner that the paper money comes in the paper money accumulating portion 700*b* (a step S009). Accordingly, the carried paper moneys are stacked in the paper money accumulating portion 700*b* (a step S010). At this time, the push plate 806*b* executes the money inputting time push plate control mentioned above.

The control portion 10 determines whether or not the carrier of the paper money is finished (a step S011), and returns the process to the step S006 if the carrier is not finished (NO in the step S011).

If the carrier is finished (YES in the step S011), the control portion 10 stops the paper money carrier paths 50 and 90 after the paper moneys are all stacked (a step S012). Further, the control portion 10 stops the internal carrier driving source 971 (the delivery roller 706 and the two-way carrier path 705), and stops the accumulation and feed driving source 972 (the stack and feed rollers 801*a* and 801*b* and the pickup rollers 811*a* and 811*b*) (a step S013).

Figure 7:
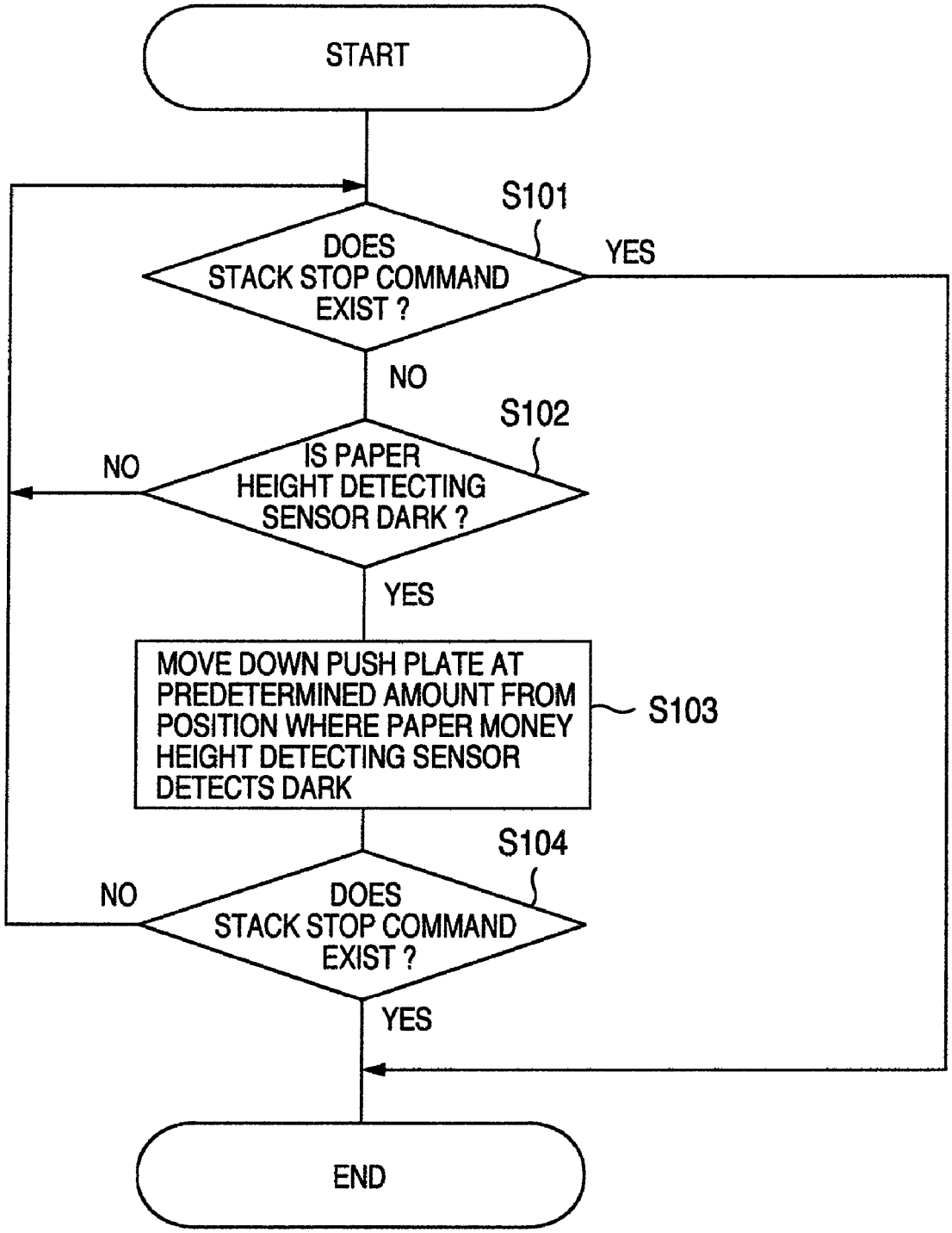
FIG. 7 is a flow chart of a push plate control motion at a time of inputting the money.

FIG. 7 is a flow chart showing a motion of the money inputting time push plate control executed during the step S008 mentioned above.

Since a stack stop command is output if the step S011 of the money inputting motion flow detects that the paper money carrier is finished, the two money kinds recycle box 95 determines whether or not the command exists (a step S101).

If the stack stop command exists (YES in the step S101), the two money kinds recycle box 95 finishes the push plate control.

If the stack stop command does not exist (NO in the step S101), the two money kinds recycle box 95 detects whether or not the paper money height is a height suitable for stacking by a paper money height detecting sensor (not shown) (a step S102).

If the paper money height detecting sensor is kept light (NO in the step S102), the two money kinds recycle box 95 returns the process to the step S101 and keeps stacking.

If the paper money height becomes too high and the paper money height detecting sensor is dark (YES in the step S102), the two money kinds recycle box 95 moves the push plate 806 to a position (a stack position) which is down at a predetermined amount from the dark position of the paper money height detecting sensor (a step S103).

The two money kinds recycle box 95 determines whether or not the paper money carrier is finished during the driving of the push plate and the stack stop command is output (a step S104).

The two money kinds recycle box 95 finishes the push plate control if the stack stop command exists (YES in the step S104), and returns the process to the step S101 and keeps stacking if the stack stop command does not exist (NO in the step S104).

On the basis of the money inputting time push plate control, the two money kinds recycle box 95 monitors the height of the paper money existing at the top by a paper money height detecting sensor (not shown) detecting the height of the paper money existing at the top of the accumulated paper money bundle. In the case that the paper money height becomes high by the accumulation of the paper money, and is not suitable for stacking (the sensor dark position), the push plate 806*a* is moved down by the push plate driving source 973 so as to be moved to a suitable stack position. The stack position is set to a position which is down at a predetermined amount from the height at which the paper money height detecting sensor detects the dark. The money inputting time push plate control independently controls so as to drive the push plates 806*a* and 806*b* by the independently driven push plate driving sources 973*a* and 973*b*, in the paper money accumulating portions 700*a* and 700*b*.

Next, a description will be given of a motion at a time of a money output dealing process.

At a time of the money output dealing process, a predetermined number of paper moneys are fed from the one money kind recycle box 80 or the paper money accumulating portions (700*a* and 700*b*) per the money kinds in the two money kinds recycle box 95, and are supplied to the paper money discriminating portion 30. In the paper money discriminating portion 30, the money kind is discriminated. Further, the switching gate 503 is switched in such a manner that the paper is stored in the money input and output port 20 side, whereby the paper money passing through the paper money discriminating portion 30 is stored in the money input and output port 20, and the user can thereafter take the paper money by opening the shutter on the upper surface of the paper money slot 20*a*. If the user receives the paper money within the storage portion, the money outputting process is finished.

Figure 8:
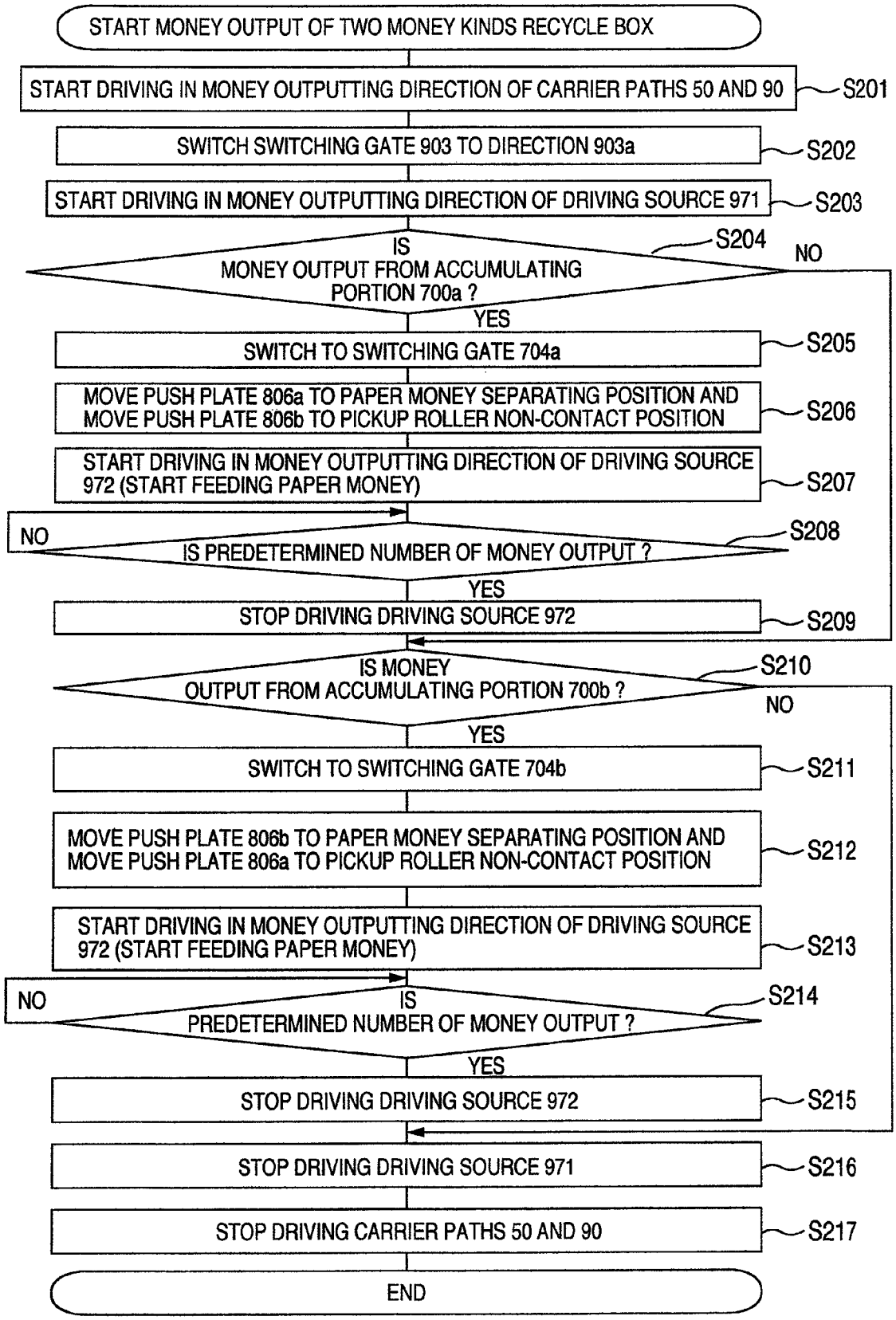
FIG. 8 is a flow chart of a separating and feeding motion from the two money kinds recycle box.

FIG. 8 is a flow chart mainly showing a separating and feeding motion from the two money kinds recycle box 95 at a time of the money output dealing process mentioned above.

First, the control portion 10 starts driving the paper money carrier paths 50 and 90 in the money outputting direction (a step S201).

The control portion 10 switches the switching gate 903 (the gate existing short of the two money kinds recycle box) to a direction 903*a*, whereby the paper money can be output from the two money kinds recycle box (a step S202).

The control portion 10 drives the internal carrier driving source 971 in the money outputting direction, thereby driving the delivery roller 706 and the two-way carrier path 705 in the money outputting direction (a step S203).

The control portion 10 determines whether the money kind of the output money is the money kind stored in the paper money accumulating portion 700*a*, or the money kind stored in the paper money accumulating portion 700*b* (a step S204). In the case of outputting both the money kinds, the paper moneys are set to be output from the paper money accumulating portion 700*a* in the present embodiment.

In the case that the money kind stored in the paper money accumulating portion 700*a* is not output (NO in the steps S204), the process is proceeded to a step S210.

In the case that the money kind stored in the paper money accumulating portion 700*a* is output (YES in the step S204), the control portion 10 switches the switching gate 704 (the branch between the direction of the paper money accumulating portion 700*a* and the direction of the paper money accumulating portion 700*b*) to the direction 704*a* in such a manner that the paper money output from the paper money accumulating portion 700*a* is carried (a step S205).

The control portion 10 drives the push plate 806*a* in such a manner that the height of the push plate 806*a* or of the paper money on the top surface of the paper moneys on the push plate 806*a* comes to a position (a paper money separating position) suitable for separating the paper money (a step S206). The paper money separating position is set to a position at which the push plate 806*a* is moved up until the pressure of the pickup roller 811*a* to the paper money becomes a predetermined force. For detecting the pressing force, there is provided a pressing force detecting sensor (not shown) which becomes dark at a time when the pressure of the pickup roller 811*a* comes to a predetermined force or more.

At the same time, the control portion 10 moves down the push plate (the push plate 806*b* in this embodiment) of the other accumulating portion (the paper money accumulating portion 700*b*) than the paper money accumulating portion 700*a* to a position at which the paper money does not come into contact with the pickup roller (the pickup roller 811*b* in this embodiment).

Accordingly, in the present embodiment, the pickup rollers 811*a* and 811*b* and the stack and feed rollers 801*a* and 801*b* of both the paper money accumulating portion 700*a* and the paper money accumulating portion 700*b* are driven by one accumulation and feed driving source 972, and are simultaneously rotated, however, in the accumulating portion of the money kind which is not fed, it is possible to keep off the paper money from the pickup rollers 811*a* and 811*b*, and it is possible to feed the paper money only from the target accumulating portion.

The control portion 10 drives the stack and feed roller 801*a* and the pickup roller 811*a* in the money outputting direction by driving the accumulation and feed driving source 972 so as to start feeding the paper money (a step S207)). During this time, the control portion 10 executes the money outputting time push plate control of adjusting the height of the push plate 806*a* in correspondence to the height of the paper money which is fed so as to be reduced.

The control portion 10 determines whether or not a predetermined number of paper moneys are fed (a step S208), and keeps feeding the paper money until the feed is finished (NO in the step S208).

If the control portion 10 detects the end of the predetermined number of paper money feed (YES in the step S208), the control portion 10 stops the pickup roller 811*a* by stopping the accumulation and feed driving source 972 and stops the feed of the paper money (a step S209).

The control portion 10 determines whether or not the money kind stored in the paper money accumulating portion 700*b* is output (a step S210). In the case of determining that the money kind stored in the paper money accumulating portion 700*b* is not output (NO in the step S210), the control portion 10 proceeds the process to a step S216.

In the case of determining that the money kind stored in the paper money accumulating portion 700*b* is output (YES in the step S210), the control portion 10 switches the switching gate 704 (the branch between the directions of the paper money accumulating portions 700*a* and 700*b*) to the direction 704*b* in such a manner that the paper money output from the paper money accumulating portion 700*b* is carried (a step S211).

The control portion 10 drives the push plate 806*b* in such a manner that the height of the push plate 806*b* or the paper money on the top surface of the paper money on the push plate 806*b* comes to a position (a paper money separating position) suitable for separating the paper money (a step S212). The paper money separating position is set to a position obtained by moving up the push plate 806*b* until the pressure of pickup roller 811*b* applied to the paper money comes to a predetermined force. A pressure detecting sensor (not shown) which becomes dark at a time when the pressure of the pickup roller 811*b* comes to the predetermined force or more is provided for detecting the pressing force.

At the same time, the control portion 10 moves down the push plate (the push plate 806*a* in this embodiment) of the other accumulating portion (the paper money accumulating portion 700*a* in this embodiment) than the paper money accumulating portion 700*b* to a position at which the paper money is not in contact with the pickup roller (the pickup roller 811*a* in this embodiment).

Accordingly, in the present embodiment, the pickup rollers 811*a* and 811*b* and the stack and feed rollers 801*a* and 801*b* of both the paper money accumulating portions 700*a* and 700*b* are driven by one accumulation and feed driving source 972, and are simultaneously rotated, however, in the accumulating portion of the money kind which is not fed, it is possible to keep off the paper money from the pickup roller 811*b*, and it is possible to feed the paper money only from the target accumulating portion.

The control portion 10 drives the stack and feed roller 801*b* and the pickup roller 811*b* in the money outputting direction by driving the accumulation and feed driving source 972 in the money outputting direction, so as to start feeding the paper money (a step S213).

The control portion 10 determines whether or not a predetermined number of paper moneys are fed (a step S214), and keeps feeding the paper money until the feed is finished (NO in the step S214).

If the control portion 10 detects the end of the predetermined number of feed (YES in the step S214), the control portion 10 stops the pickup roller 811*b* by stopping the accumulation and feed driving source 972, so as to stop feeding the paper money (a step S215).

The control portion 10 stops the internal carrier driving source 971, stops the delivery roller 706 and the two-way carrier path 705 (a step S216), and stops the paper money carrier paths 50 and 90 (a step S217).

Figure 9:
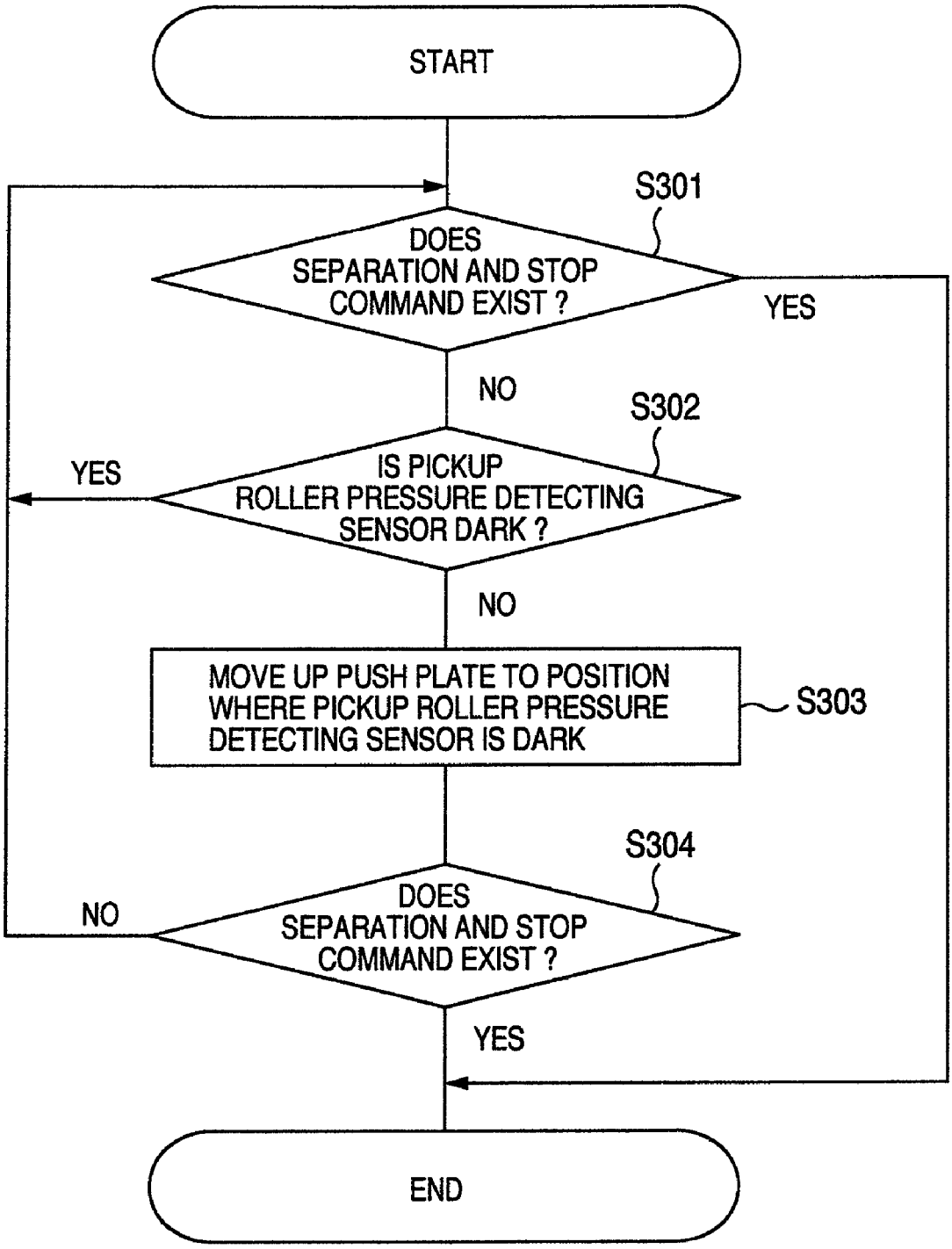
FIG. 9 is a flow chart of the push plate control motion at a time of outputting the money.

FIG. 9 is a flow chart showing a motion of the money outputting time push plate control executed during the steps S207 and 213 mentioned above.

If the step S208 or the step S214 of the money outputting motion detects that the money output of the corresponding money kind is finished, the separation stop command is output. Accordingly the two money kinds recycle box 95 determines whether or not the command exists (a step S301).

In the case of determining that the separation stop command is generated (YES in the step S301), the two money kind recycle box 95 finishes the push plate control.

In the case that the separation stop command does not exist (NO in the step S301), the two money kinds recycle box 95 determines whether or not the pressing force of the pickup roller 811*a* or 811*b* detected by the pressure detecting sensor comes to a suitable force for separating (a step S302).

If the pressure detecting sensor is dark (NO in the step S302), the two money kinds recycle box 95 returns the process to the step S301 and keeps separating.

If the paper money height becomes low together with the money output and the pressure detecting sensor of the pickup roller is light (NO in the step S302), the two money kinds recycle box 95 moves up the push plate 806*a* or 806*b* to a position at which the pressure detecting sensor of the pickup roller 811*a* or 811*b* becomes dark (a step S303).

The two money kinds recycle box 95 determines whether or not the paper money carrier is finished during the push plate driving and the separation stop command is output (a step S304).

If the separation stop command does not exist (NO in the step S304), the two money kinds recycle box 95 returns the process to the step S301, and keeps separating.

If the separation stop command exists (YES in the step S304), the two money kinds recycle box 95 finishes the push plate control.

In accordance with the money outputting time push plate control, the two money kinds recycle box 95 can adjust the height of the push plates 806*a* and 806*b* in correspondence to the number of the output money in such a manner that the position of the top surface of the accumulated paper money comes to the position suitable for separating during the output of the paper money.

In the present embodiment, since the position (the paper money separating position) of the push plates 806*a* and 806*b* suitable for separating is set to "position at which the push plate is moved up until the pressing force of the pickup rollers 811*a* and 811*b* applied to the paper money comes to the predetermined force", it is possible to prevent the feed fault of the paper money due to the improperness of the pressing force.

Further, since there is provided the pressure detecting sensor (not shown) which becomes dark at a time when the push plates 806*a* and 806*b* are moved up, the paper money is pressed to the pickup rollers 811*a* and 811*b* and the pressing force comes to the predetermined force or more, for detecting the pressing force, it is possible to suitably control so as to drive the push plates 806*a* and 806*b*. In other words, if the pressing force is lowered by the reduction of the height of the accumulated paper moneys together with the money output, the pressure detecting sensor becomes light, and the push plate is moved up until the pressure detecting sensor becomes dark after becoming light. Accordingly, it is possible to always apply the suitable pressing force.

In accordance with the structures and motions mentioned above, it is possible to provide the two money kinds recycle box 95 which is provided with a plurality of paper money accumulating portions 700*a* and 700*b* storing the paper sheets, and carries out the storage and the feed of the paper sheets at one position (the output and input port 702), simplify the structures of the paper money carrier paths 50 and 90 of a whole of the paper money inputting and outputting machine 1 provided with the two money kinds recycle box 95, and correspond to a compact structure and many money kinds.

Since two push plates 806*a* and 806*b* are structured such as to be independently moved up and down by the independent push plate driving sources 973*a* and 973*b*, it is possible to suitably move down and up the push plates in correspondence to the stored number at a time of inputting and outputting the money, even if the stored numbers of the paper moneys stored in two paper money accumulating portions 700*a* and 700*b*.

Further, since the structure is made such as to work the stack and feed rollers 801*a* and 801*b* with the pickup rollers 811*a* and 811*b* by the one accumulation and feed driving source 972, it is possible to achieve a cost reduction on the basis of the reduction of the parts number by making the driving sources in common, and it is possible to simplify the control.

In this case, in the present embodiment, the cost reduction is achieved by structuring such that the delivery roller 706 and the two-way carrier path 705 are driven by one internal carrier driving source 971, and structuring such that the stack and feed rollers 801*a* and 801*b* and the pickup rollers 811*a* and 811*b* are driven by one accumulation and feed driving source 972, however, they may be driven by the respective independent driving sources.

Further, in the two money kinds recycle box 95, it is possible to make use of one of two paper money accumulating portions 700*a* and 700*b* as the paper money storage used for outputting the money, or it is possible to make use of it as the storage accumulating the paper money which is not used for outputting the money in the same manner as the reject box 60 without outputting the money.

Further, in the embodiment mentioned above, the two money kinds recycle box 95 is provided with two paper money accumulating portions 700*a* and 700*b*, however, may be provided with three or four independent accumulating portions in some intended use.

Figure 10:
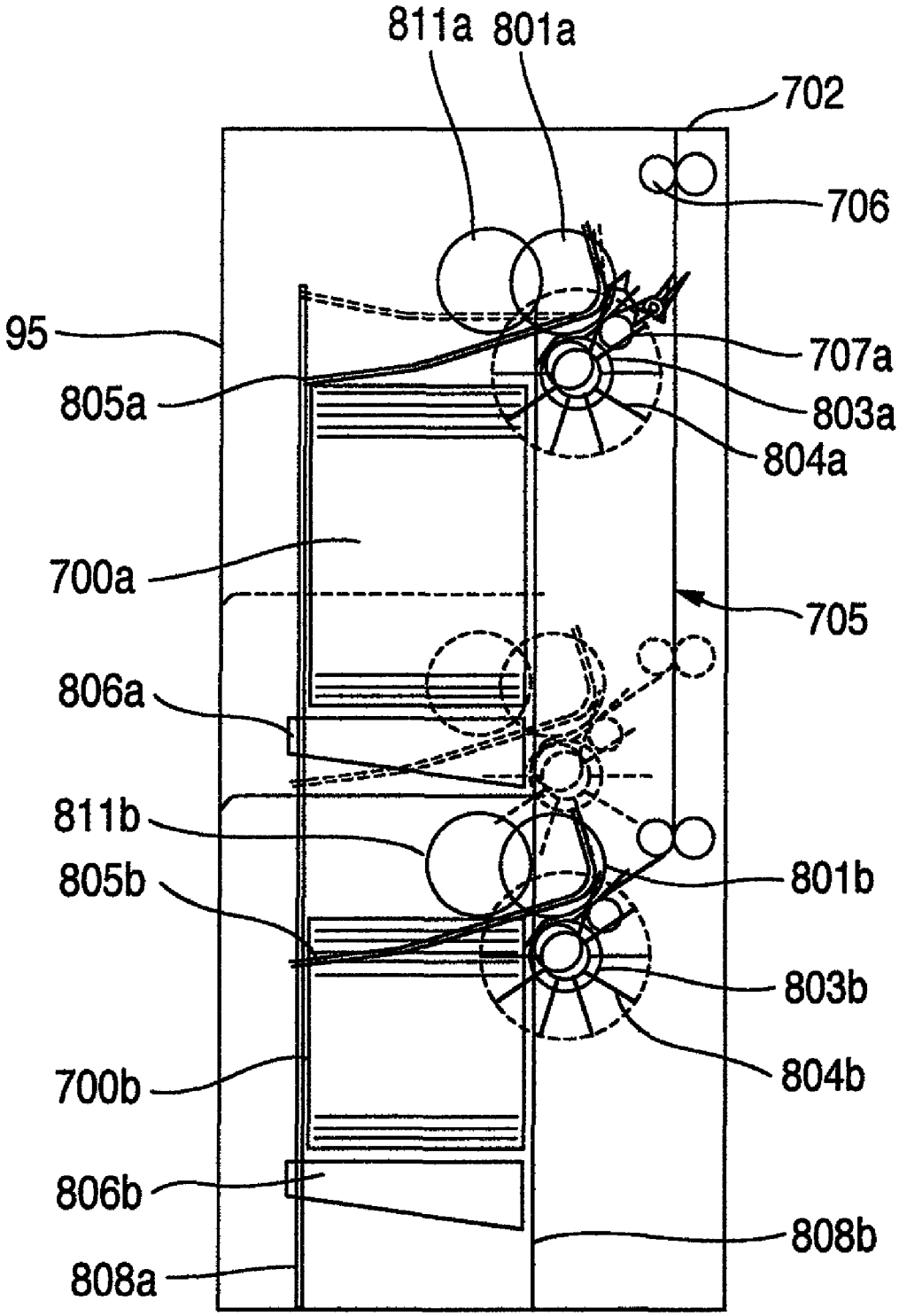
FIG. 10 is a schematic view of a two money kinds recycle box in accordance with the other embodiment.

Further, as shown in the schematic view in FIG. 10, it is possible to make the paper money accumulating capacities of the paper money accumulating portions 700*a* and 700*b* variable by structuring such as to easily change the upper and lower positions of the stack and separating mechanism (the stack and feed roller 801, the pickup roller 811, the gate roller 803, the brush roller 804, the separating and stack guide 805 and the subordinate mechanisms) of the paper money accumulating portion 700*b*. In accordance with the structure mentioned above, it is possible to make use by changing the capacity of the accumulating portion in accordance with the intended use. For example, it is possible to make use such that the money kind having a less distribution amount is stored in the paper money accumulating portion 700*b* having a small capacity by moving the stack and separating mechanism of the paper money accumulating portion 700*b* downward as shown in FIG. 6, and the money kind having a more distribution is stored in the paper money accumulating portion 700*a* having a large capacity.

The present invention is not limited only to the structure in accordance with the embodiment mentioned above, but a lot of embodiments can be obtained.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper sheets storage comprising:

a paper sheets output and input portion outputting and inputting paper sheets with respect to an external portion;

a plurality of storage portions configured to store paper sheets, said plurality of storage portions disposed in a plurality of boxes situated adjacently in a horizontal direction, each box containing therein at least one storage portion, wherein when a box contains more than one storage portion, said storage portions are situated adjacently in a vertical direction;

an accumulating and feeding motion portion provided at a position in each of said storage portions and configured to carry out an accumulating motion of a paper sheet to said storage portion and a feeding motion of paper sheets from said storage portion; and an internal carrier path configured to carry paper sheets in a two-way direction between said paper sheets output and input portion and said plurality of accumulating and feeding motion portions;

wherein said paper sheets output and input portion is provided to be broadly divided from said plurality of paper sheets storage portions by a carrier path that carries paper sheets; and wherein the paper sheets storage further comprises:

a stage configured to support the stored paper sheets in a state in which a plurality of paper sheets are superimposed, in each of said storage portions; and a stage moving means for moving said stage in said superimposing direction independently from the stage of the other storage portion, and wherein a plurality of said accumulating and feeding motion portions are interlocked by a driving means.

2. A paper sheets storage comprising:

a paper sheets output and input portion configured to output and input paper sheets with respect to an external portion;

a plurality of storage portions configured to store paper sheets, said plurality of storage portions disposed in a plurality of boxes situated adjacently in a horizontal direction, each box containing therein at least one storage portion, wherein when a box contains more than one storage portion, said storage portions are situated adjacently in a vertical direction;

an accumulating and feeding motion portion provided at a position in each of said storage portions and configured to carry out an accumulating motion of a paper sheet to said storage portion and a feeding motion of the paper sheets from said storage portion; and an internal carrier path configured to carry paper sheets in a two-way direction between said paper sheets output and input portion and said plurality of accumulating and feeding motion portions;

wherein said paper sheets output and input portion is provided to be broadly divided from said plurality of paper sheets storage portions by a carrier path that carries paper sheets;

wherein said paper sheets output and input portion is provided with a delivering motion portion corresponding to a delivery end of paper sheets, independently configured to be driven from an external carrier path provided in an external portion and configured to carry out a motion of delivering paper sheets to said external carrier path;

wherein the paper sheets storage further comprises:

a stage configured to support the stored paper sheets in a state in which a plurality of paper sheets are superimposed, in each of said storage portions; and a stage moving means for moving said stage in said superimposing direction independently from the stage of the other storage portion, and wherein a plurality of said accumulating and feeding motion portions are interlocked by a driving means.

3. A paper sheets storage comprising:

a paper sheets output and input portion outputting and inputting paper sheets with respect to an external portion;

a plurality of storage portions configured to store paper sheets, said plurality of storage portions disposed in a plurality of boxes situated adjacently in a horizontal direction, each box containing therein at least one storage portion, wherein when a box contains more than one storage portion, said storage portions are situated adjacently in a vertical direction;

an accumulating and feeding motion portion provided at a position in each of said storage portions and configured to carry out an accumulating motion of a paper sheet to said storage portion and a feeding motion of the paper sheets from said storage portion; and an internal carrier path configured to carry paper sheets in a two-way direction between said paper sheets output and input portion and said plurality of accumulating and feeding motion portions;

wherein said paper sheets output and input portion is provided to be broadly divided from said plurality of paper sheets storage portions by a carrier path that carries paper sheets; and wherein said paper sheet output and input portion is provided with a delivering motion portion independently configured to be driven from said accumulating and feeding motion portion, corresponding to a delivery end of paper sheets and configured to carry out a motion of delivering paper sheets to an external path provided in the external portion;

wherein the paper sheets storage further comprises:

a stage configured to support the stored paper sheets in a state in which a plurality of paper sheets are superimposed, in each of said storage portions; and a stage moving means for moving said stage in said superimposing direction independently from the stage of the other storage portion, and wherein a plurality of said accumulating and feeding motion portions are interlocked by a driving means.

4. A paper sheets storage as claimed in claim 1, wherein a detecting means for detecting a feed fault of paper sheets is provided near each of said accumulating and feeding motion portions, and wherein when the feed fault is detected by said detecting means, said accumulating and feeding motion portion is configured to be driven in a reverse direction by said driving means while keeping the carrying drive of said internal carrier path.

5. A paper sheets storage as claimed in claim 2, wherein a detecting means for detecting a feed fault of paper sheets is provided near each of said accumulating and feeding motion portions, and wherein when the feed fault is detected by said detecting means, said accumulating and feeding motion portion is configured to be driven in a reverse direction by said driving means while keeping the carrying drive of said internal carrier path.

6. A paper sheets storage as claimed in claim 3, wherein a detecting means for detecting a feed fault of paper sheets is provided near each of said accumulating and feeding motion portions, and wherein when the feed fault is detected by said detecting means, said accumulating and feeding motion portion is configured to be driven in a reverse direction by said driving means while keeping the carrying drive of said internal carrier path.

7. A paper sheets handling apparatus comprising:

an input and output port allowing an input and output of paper sheets by a user;

a discriminating portion discriminating paper sheets;

a first paper sheets storage having a plurality of storages as claimed in any one of claims 1 to 3, and a second paper sheets storage having a storage configured to store paper sheets, and an accumulating and feeding motion portion configured to carry out an accumulating motion of paper sheets to said storage portion and a feeding motion of paper sheets from said storage portion; and a plurality of storage installing portions to which any of said first paper sheets storage and said second paper sheets storage is installable.

8. A paper sheets storage comprising:

a paper sheets output and input portion outputting and inputting paper sheets with respect to an external portion;

a plurality of storage portions configured to store paper sheets, said plurality of storage portions disposed in a plurality of boxes situated adjacently in a horizontal direction, each box containing therein at least one storage portion, wherein when a box contains more than one storage portion, said storage portions are situated adjacently in a vertical direction;

an accumulating and feeding motion portion provided at a position in each of said storage portions and configured to carry out an accumulating motion of a paper sheet to said storage portion and a feeding motion of paper sheets from said storage portion; and an internal carrier path configured to carry paper sheets in a two-way direction between said paper sheets output and input portion and said plurality of accumulating and feeding motion portions;

a stage configured to support the stored paper sheets in a state in which a plurality of paper sheets are superimposed, in each of said storage portions; and a stage moving means for moving said stage in said superimposing direction independently from the stage of the other storage portion, and wherein a plurality of said accumulating and feeding motion portions are interlocked by a driving means.

9. A paper sheets storage as claimed in claim 8, wherein a detecting means for detecting a feed fault of paper sheets is provided near each of said accumulating and feeding motion portions, and wherein when the feed fault is detected by said detecting means, said accumulating and feeding motion portion is configured to be driven in a reverse direction by said driving means while keeping the carrying drive of said internal carrier path.

* * * * *